United States Patent [19]

McAvinew

[11] Patent Number: 4,896,475

[45] Date of Patent: Jan. 30, 1990

[54] ROCKER FRAME

[75] Inventor: Dennis M. McAvinew, Mogadore, Ohio

[73] Assignee: Polysar Financial Services S.A., Fribourg, Switzerland

[21] Appl. No.: 312,922

[22] Filed: Feb. 21, 1989

[51] Int. Cl.[4] ..... B65B 25/14

[52] U.S. Cl. ..... 53/117; 53/259; 53/473; 493/415

[58] Field of Search ..... 53/117, 429, 473, 475, 53/259, 263, 116; 493/415, 414, 413, 411

[56] References Cited

U.S. PATENT DOCUMENTS

| | | | |
|---|---|---|---|
| 966,760 | 8/1910 | Mutschler | 493/415 |
| 2,218,062 | 10/1941 | Yates | 493/415 X |
| 3,915,883 | 7/1965 | Southwell et al. | 493/415 X |
| 3,938,299 | 2/1976 | Lerner | 53/385 X |
| 4,716,706 | 1/1988 | Boeckmann | 53/117 |

FOREIGN PATENT DOCUMENTS

| | | | |
|---|---|---|---|
| 1275075 | 8/1968 | Fed. Rep. of Germany | 493/415 |

*Primary Examiner*—James F. Coan

*Attorney, Agent, or Firm*—Stevens, Davis, Miller & Mosher

[57] ABSTRACT

A rocker frame cooperating with a belt conveyor carrying on one end of said rocker frame a pair of cooperating rollers, one of which is powered, is useful to package thin webs or strips of material in partitioned packages. The frame sweeps out a repeating arcuate path which automatically folds the material back upon itself.

10 Claims, 2 Drawing Sheets

ROCKER FRAME

BACKGROUND OF THE INVENTION

The present invention relates to a rocker frame for use in association with a conveyor means. More particularly, the rocker frame of the present invention may be used in association with a belt conveyor in the packaging of one or more narrow webs of material in a partitioned container or box.

In the packaging of one or more narrow webs of materials such as textile ribbons, or ribbons of materials such as elastomers in a partitioned box, it has been necessary to manually fold the ribbon material back and forth upon itself as it comes off the conveyor. For heavy materials there is an apparatus available to do this. For lighter materials it has been necessary to do this by hand. This is a labour intensive job and thus expensive.

PRIOR ART

U.S. Pat. No. 3,938,299 issued Feb. 17, 1976 disclosed an apparatus for packaging articles in a web container. While the device contains a rocker arm, it does not contain a drive roller on the rocker arm. Rather the rocker arm acts in tensioning and accumulating the web prior to feeding it to the loading station. The reference does not suggest the rocker arm of the present invention.

SUMMARY OF THE INVENTION

In accordance with the present invention there is provided a rocker frame adapted to be used in cooperation with a belt conveyor comprising pivot means adjacent the termination of, and aligned with said conveyor, at least a pair of substantially equilength parallel side members spaced apart substantially the width of said conveyor mounted on said pivot means and joined at their ends distant from said conveyor by an end member, at least one guide member parallel to said end member attached to said side members bearing on its surface facing away from said belt conveyor adjustable divider means, adjacent the end of said rocker frame distant from said conveyor a pair of rollers held in contact by a biasing means, one of said rollers being driven by a variable speed drive means, and pivot drive means to rock said frame on said pivot means so that said rollers sweep out an arcuate path.

In accordance with present invention there is also provided a cooperating rocker frame and conveyor adapted to transport and package one or more continuous strips of narrow gauge web material in a compartmentalized package comprising a belt conveyor having at its terminal end a depending rocker frame joined to each side of said conveyor frame by a pivot means, said rocker frame comprising at least two substantially equilength side members, spaced apart approximately the width of said conveyor an end member joining said side members, two rubber rollers adjacent said end member held in contact by a pneumatic cylinder and piston means, one of said rollers being driven by a variable speed motor, a guide member parallel to and adjacent said end member and joining said side members, said guide member adapted to receive and bearing divider pins, and a rocker drive means, one end of which is attached to the frame for said conveyor and the other end of which is attached to said rocker frame.

BRIEF DESCRIPTION OF THE DRAWINGS

The present invention will be described in accordance with the accompanying drawings which are schematic drawings of a preferred embodiment of the invention.

DETAILED DESCRIPTION OF THE INVENTION

The apparatus of the present invention provides an automated device which is useful in concurrently packaging one or more strips of webbing or ribbons of materials in multicompartment boxes. The apparatus is particularly useful in loading one or more narrow strips of elastomer in partitioned boxes. Typically, the rubber strips are up to about 12.5 cm (5 inches) preferably less than 7.5 cm (3 inches) most preferably less than 5 cm (2 inches) in width.

Figure 1:
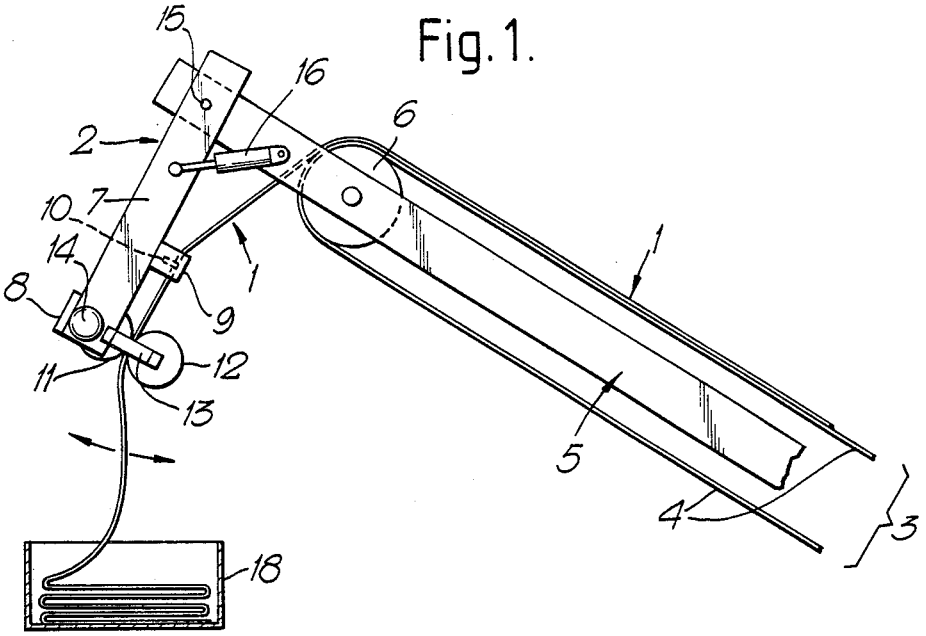
FIG. 1 is a side view of a conveyor and rocker frame embodiment of the invention.
Figure 2:
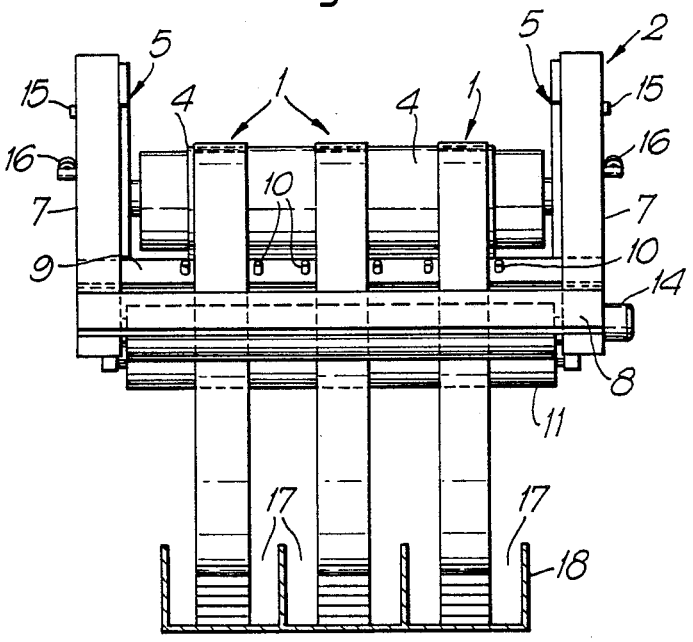
FIG. 2 is a front view of the rocker frame of FIG. 1.

In FIGS. 1, and 2 one or more strips, webs or ribbons of materials 1, such as textiles or rubber are transported to the rocker frame 2 by a belt conveyor 3 comprising a belt 4, a frame 5 and a terminal roller 6. In FIGS. 1 and 2 the rocker frame comprises parallel side members 7, spaced apart approximately the width of said conveyor, joined at their ends distant from the conveyor, by an end member 8. A transverse guide member 9 joins said side members between said end member and said pivot means. The guide member 9 is parallel to the end member and preferably is adjacent the end member. The guide member 9 is adapted to receive and bears on its surface which faces away from said conveyor adjustable divider means such as pins 10 which divide the space within the rocker frame into parallel zones. Suitable divider means include pins which fit into cooperating sockets or boxes. In the embodiment in FIGS. 1 and 2 a guide member is shown but a plurality of guide members could be used.

Adjacent the end member are two rollers, 11 and 12 which may be metal such as steel or may be covered with a resilient covering such as rubber. The rollers are maintained in contact by a biasing means 13. The biasing means may be a spring or a pneumatic (air) or hydraulic piston and cylinder. One of the rollers, in this case 11, is driven by a variable speed drive means 14 such as a pneumatic, such as air, an hydraulic or an electric motor .

In FIG. 1, the rocker frame 2 is attached to the conveyor frame 5 by a pivot means 15. While the illustrated embodiment shows the rocker frame attached to the conveyor means the rocker frame may be attached to a suitable base such as a ceiling or wall and in alignment with the conveyor. In the illustration the pivot means is a pin, however, the pin could replaced with other suitable pivot means such as a hinge. A pivot drive means 16 is attached at one end to the conveyor frame and at the other end to the rocker frame. Suitable pivot drive means include pneumatic and hydraulic cylinder means.

In operation a narrow web of rubber 1 travels up the conveyor 3 and is fed through rollers 11 and 12 on the rocker frame. The drive means 14 for roller 11 is operated at a speed to match the speed of the conveyor. Thus, the web is pulled off the conveyor. The pivot drive means 16 is activated to cause the rocker frame to sweep out an arc as indicated in FIG. 1. The rubber webs are laid in the various compartments 17 of box 18.

Figure 3:
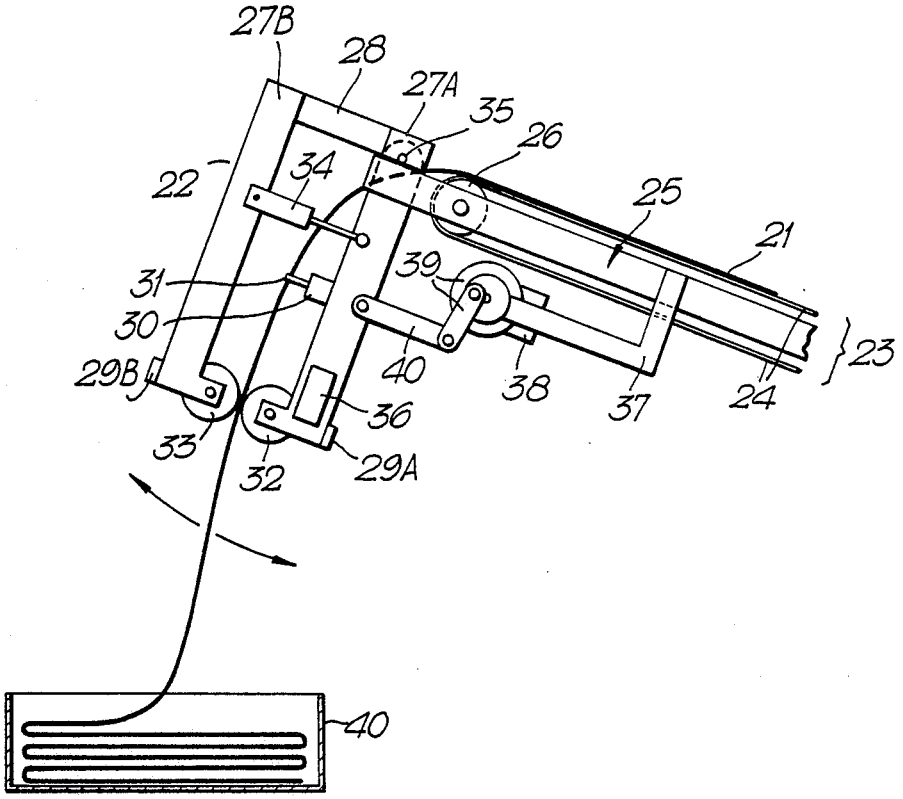
FIG. 3 is a side view of a preferred embodiment of a rocker frame of the present invention utilizing a jaw.

FIG. 3 shows a preferred embodiment of a rocker frame in accordance with the present invention. In FIG. 3 one or more strips, webs or ribbons of material 21, are transported to the rocker frame 22 by a belt conveyor 23 comprising a belt 24, a frame 25, and a terminal roller 26. The rocker frame 22 comprises jaw members comprising two pairs of cooperating upper 27B and lower 27A parallel side members spaced apart approximately the width of said conveyor and joined at their ends adjacent the terminal of the conveyor by a transverse member 28. In FIG. 3 the two pair of parallel side members are joined by a transverse member but they could also be joined in a "V" or scissor arrangement. Both said upper and lower members are mounted on a pivot means 35 to permit said jaws to both pivot or rock about the pivot means and to open and shut. Said upper parallel side members 27B and lower parallel side members 27A are joined at their ends distant from said conveyor by end member 29A and 29B respectively. A guide member 30 parallel to end member 29A joins the lower parallel side members 27A at a point between the end member 29A and the pivot means 35, preferably adjacent the end member 29A or about midway between end member 29A and pivot means 35. A plurality of guide members could also be used rather than just a single guide member.

The guide member bears on its surface facing away from the conveyor 23 a series of adjustable guide means 31. Generally, the guide means may comprise cooperating pin and box members, as illustrated in FIG. 2 at 10. Other suitable adjustable divider means are also contemplated by the present invention such as spring loaded plates on a track. Other adjustable divider means are be known to those skilled in the art.

Adjacent the end members 29A and 29B are rollers 33 and 32. The rollers may be metal rollers such as steel or they may be resilient rollers such as rubber rollers, or rubber covered metal rollers. If the rollers are metal they may be knurled or smooth, preferably smooth. The rollers are held in contact by a biasing means 34 which holds the jaws in a closed position. In the embodiment shown the biasing means is a cooperating cylinder and piston means attached at opposite or distant ends to each of said pairs of parallel side members. Preferably the piston and cylinder are pneumatic operating by air. Other suitable biasing means are known to those skilled in the art such as hydraulic cylinders and other suitable means. The advantage of such a biasing means is that the jaws may be opened to feed the strips, webs or ribbons of material 1 through the rollers 32 and 33. This is an advantage over the embodiment shown in FIGS. 1 and 2 which requires the manual feeding of the strips, webs or ribbons of material through the rollers. One of the rollers, 32 is driven by a variable speed drive means 36. Suitable drive means include a pneumatic motor such as an air motor, an hydraulic motor, or an electric motor such as direct current motor. Preferably, the motor is an air driven motor.

In FIG. 3 the rocker frame 22 is attached to the conveyor frame 25 by a pivot means 35. Attached to the conveyor frame 25 by an frame 37 is a motor 38. The motor drives an eccentric drive wheel shaft combination 9. The eccentric drive wheel and shaft drives a push rod 40 which causes the rocker frame 22 to swing back and forth. The eccentric drive wheel and shaft combination may be replaced with other suitable means to convert rotary motion into linear motion, such as a cam.

The rocking motion of the frame causes the rollers to sweep out an arcuate path. The strips, webs or ribbon of material are folded back upon themselves in box 40. Box 40 is divided into a number of longitudinal compartments.

In a preferred embodiment the various drive means are variable speed. Thus, the speed of the rollers may be matched to the speed of the conveyor. Alternately, the drive of the conveyor could be used to drive the roller. For example, the terminal roller either 6 or 26 could be coupled to a sprocket, a pair of sprockets could be mounted on the pivot, and a sprocket mounted on the drive roller. A series of chains could then be used to transmit the drive from the conveyor to the drive roller. Alternate drive means such as pulleys and "V" belts could be used in place of chains and sprockets.

The substitution of other mechanical equivalents and configuration changes in the apparatus of the invention will be apparent to those skilled in the art.

I claim:

1. A cooperating rocker frame and conveyor adapted to transport and package one or more continuous strips of narrow gauge web material in a compartmentalized package comprising a belt conveyor having at its terminal end a depending rocker frame joined to each side of said conveyor frame by a pivot means, said rocker frame comprising at least two substantially equilength side members, spaced apart approximately the width of said conveyor, an end member joining said side members, two rubber rollers adjacent said end member held in contact by a pneumatic cylinder and piston means, one of said rollers being driven by a variable speed motor, a guide member parallel to and adjacent said end member and joining said side members, said guide member adapted to receive and bearing divider pins, and a rocker drive means, one end of which is attached to the frame for said conveyor and the other end of which is attached to said rocker frame.

2. A rocker frame adapted to be used in cooperation with a belt conveyor comprising pivot means adjacent the termination of, and aligned with said conveyor, at least a pair of substantially equilength parallel side members spaced apart substantially the width of said conveyor mounted on said pivot means and joined at their ends distant from said conveyor by an end member, at least one guide member parallel to said end member attached to said side members bearing on its surface facing away from said belt conveyor, adjustable divider means, adjacent the end of said rocker frame distant from said conveyor, a pair of rollers held in contact by a biasing means, one of said rollers being driven by a variable speed drive means, and pivot drive means to rock said frame on said pivot means so that said rollers sweep out an arcuate path.

3. A rocker frame according to claim 2 wherein said pivot means and one end of said pivot drive means are attached to the fame of said conveyor.

4. A rocker frame according to claim 3 wherein said biasing means is selected from the group consisting of spring means, cooperating hydraulic piston and cylinder means, and cooperating pneumatic piston and cylinder means.

5. A rocker frame according to claim 4 wherein said variable speed drive means is selected from the group consisting of electric motors, pneumatic drive means and hydraulic drive means.

6. A rocker frame according to claim 5 wherein said guide member is adjacent said end member.

7. A rocker frame according to claim 6 wherein said rollers on said end member are rubber rollers.

8. A rocker frame according to claim 7 wherein pivot drive means comprises a cooperating cylinder and piston selected from the group consisting of hydraulic and pneumatic cylinders and pistons one end of which is attached to said conveyor frame, and the other end of which is attached to said rocker frame.

9. A rocker frame according to claim 8 wherein said frame comprises two pairs of cooperating upper and lower parallel side members joined together at their ends adjacent the terminal of said conveyor and mounted on said pivot means.

10. A rocker frame according to claim 9 wherein a roller is adjacent the end member of each pair of cooperating side members and said biasing means comprises a cooperating piston and cylinder attached at their distant ends to each of said cooperating upper and lower parallel side members.

* * * * *